US007568577B2

(12) United States Patent
Kim

(10) Patent No.: US 7,568,577 B2
(45) **Date of Patent: *Aug. 4, 2009**

(54) TIE AND HANDKERCHIEF RETAIL DISPLAY UNIT

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 508 days.

This patent is subject to a terminal disclaimer.

(21) Appl. No.: 11/216,268

(22) Filed: Aug. 30, 2005

(65) Prior Publication Data

US 2007/0045136 A1 Mar. 1, 2007

(51) Int. Cl.
*B85D 85/18* (2006.01)

(52) U.S. Cl. ..... 206/278; 206/292; 206/806; 206/495; 223/87

(58) Field of Classification Search ..... 206/278, 206/288, 746, 806, 6.1, 279, 284, 287.1, 206/289, 292, 297, 294; 223/DIG. 1, 85, 223/87, 88, 98

See application file for complete search history.

(56) References Cited

U.S. PATENT DOCUMENTS 3,069,009 A * 12/1962 Hoeflich ..... 206/284
3,081,881 A * 3/1963 Seeger ..... 211/85.3
3,370,765 A * 2/1968 Jossem ..... 223/87
3,592,343 A * 7/1971 Swett et al. ..... 211/123
3,783,995 A * 1/1974 Tobin ..... 206/232
4,190,151 A * 2/1980 Russell ..... 206/281
4,811,852 A * 3/1989 Kelly ..... 211/119
5,013,004 A * 5/1991 Wilkins et al. ..... 248/692
5,664,669 A * 9/1997 VanFleet ..... 206/6.1
6,032,793 A * 3/2000 Oakley ..... 206/296
6,237,762 B1 * 5/2001 Faircloth ..... 206/299
2004/0112772 A1 * 6/2004 Kimura ..... 206/297

* cited by examiner

*Primary Examiner*—Mickey Yu
*Assistant Examiner*—Steven A. Reynolds
(74) *Attorney, Agent, or Firm*—Leason Ellis LLP

(57) ABSTRACT

A display unit for a tie and a handkerchief includes a substrate having first and second panels arranged along an axis, a pair of first flaps attached to the first panel and being pivotally mounted in a direction generally parallel to the axis, a pair of second flaps attached to the second panel and pivotal in the first direction, a hole through the substrate, a fold at the union of the first and second panels, a securement that holds the first and second panels to one another and a hanger seated in the hole comprising a hook, a downwardly depending neck, and an engagement surface which is larger than the hole.

16 Claims, 4 Drawing Sheets

FIGURE 5
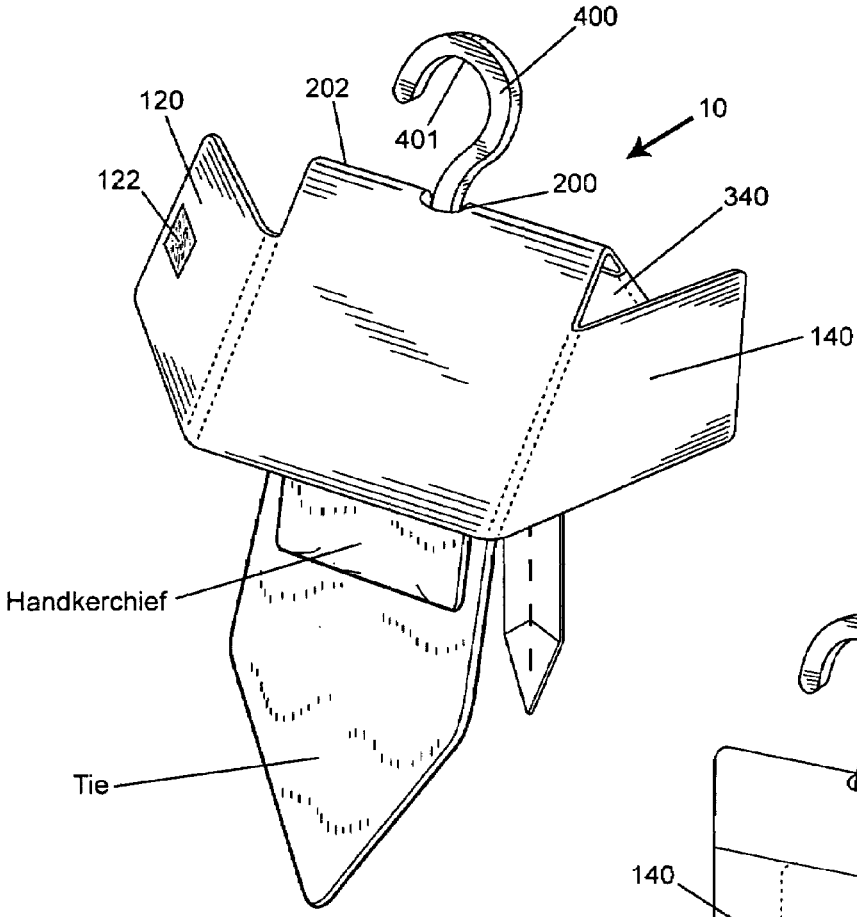
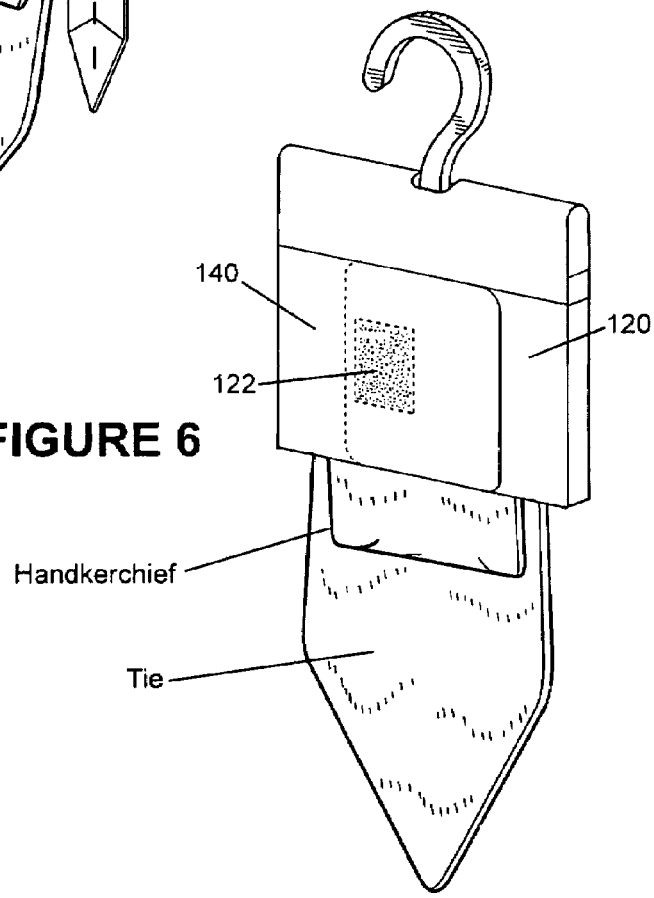
FIGURE 6

TIE AND HANDKERCHIEF RETAIL DISPLAY UNIT

FIELD OF THE INVENTION

The present invention relates to packaging, and more particularly to retail display units for clothing and clothing accessories.

BACKGROUND OF THE INVENTION

It is generally desirable in the sale of fashion items and accessories to present the merchandise in a manner that permits potential customers to have a good look at the products. It is also important for retailers to be able to maintain the orderly condition of their wares so that their displays remain attractive to passersby. Packaging is conventionally selected to address these needs; however, special considerations come into play when selling two products together, such as when selling a necktie and handkerchief in combination. For example, it is desirable to permit them to be priced and sold as a unit and to prevent separation of one from the other. There is a need in the art for improved display units adapted to the sale of necktie and handkerchief combinations. The present invention satisfies these and other needs.

SUMMARY OF THE INVENTION

In accordance with one aspect of the present invention, a display unit for a tie and handkerchief is provided which comprises a substrate having at least first and second panels that are arranged adjacent one another along an axis. A first pair of flaps is attached to the first panel on opposing sides of the axis and are connected for pivotal movement in a first direction that is generally parallel to the axis. A second pair of flaps are attached to the second panel, on opposing sides of the axis, and are also pivotal in the first direction. A fold is defined at the union of the at least first and second panels, and a hole is disposed proximate to or at the fold. A securement holds the at least first and second panels in a closed configuration with the tie and handkerchief disposed in the display unit. A hanger is seated in the hole and includes a hook for mounting the display unit to a display, a neck depending downwardly from the hook, and an engagement surface which seats the hanger within the substrate.

In accordance with a more particular aspect of the embodiment of the invention, the engagement surface of the hanger includes opposing shoulders, each of which has a slot that extends toward one another. In this aspect, top and bottom portions of the shoulders receive a portion of the substrate within the respective slots to thereby engage the hanger to the substrate.

In accordance with a further aspect of the invention, a method for combining a necktie and handkerchief into a display unit is provided. The method comprises the steps of disposing the handkerchief and the tie on a substrate of the display unit. The substrate has a first and second panel, such as described above. A first pair of flaps extending from a panel are secured to one another over the combined tie and handkerchief. The first panel is folded so as to overlie the second panel with the handkerchief and tie disposed therebetween. The first and second panel are secured to one another to complete the combination.

BRIEF DESCRIPTION OF THE DRAWINGS

FIG. 5 is a perspective view of the display unit with flaps in the first position.

FIG. 6 is a rear perspective view of the display unit with flaps folded into the second position.

DETAILED DESCRIPTION OF CERTAIN EMBODIMENTS

By way of overview and introduction, a present invention provides a display unit 10 for securing a tie and handkerchief together for presentation to potential customers. The display unit 10 secures the tie and handkerchief so as to permit them to be priced and sold as a unit, and so as to prevent separation of one from the other.

Figure 1:
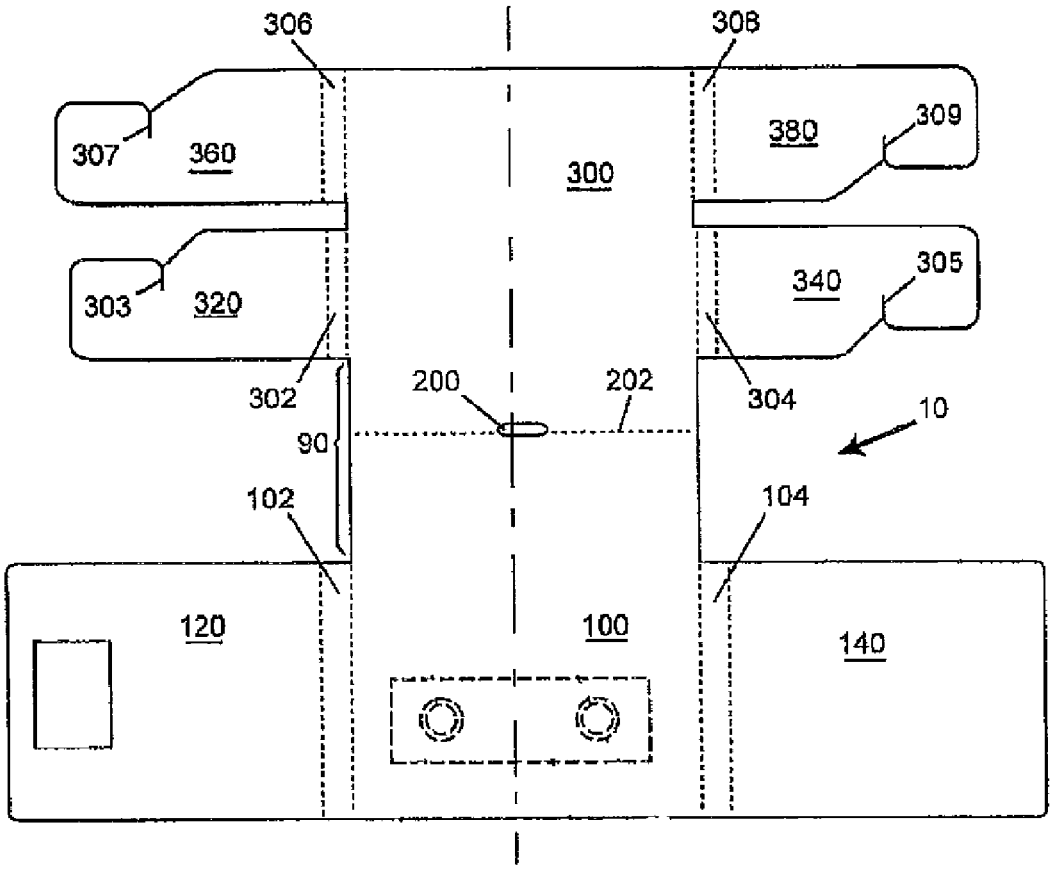
FIG. 1 is an inside top plan view of the display unit in accordance with a preferred embodiment.

Referring now to FIG. 1, the display unit 10 that comprises a substrate 90 having a first panel 100 and a second panel 300 arranged along an axis A upon which the tie and handkerchief (not shown) are disposed. The entire display unit 10 can be composed of cardboard or any other material that can flex about a fold 202. In the illustrated embodiment, flaps 320, 360 extend from the second panel 300 on one side of the axis A and flaps 340, 380 extend from the opposite side of the axis A. Flaps 320, 360 can instead comprise a single flap, and flaps 340, 380 can also comprise a single flap.

Preferably, the flaps have notches 303, 305, 307, 309, as illustrated, which affix opposing flaps 320, 340 and 369, 380 together. Instead of notches, the flaps can be affixed with other securements such as a crimp, glue, tape, or other arrangements of fingers and slots than as illustrated.

Each of these flaps 320, 340, 360, 380 preferably can fold or pivot generally parallel to the axis A at 302, 304, 306, 308. Such movement of the panels better accommodates the thickness of the tie and handkerchief.

The display unit 10 also comprises a hole 200 in the union of the first and second panels to be used by the hanger 400, described below. Preferably, the hole 200 is aligned with the fold 202 so that the hanger 400 projects directly from a top margin of the display unit 10, when folded at 202 (see FIG. 5).

Referring again to FIG. 1 the first panel 100 includes first flaps 120, 140 extending from opposing sides of the first panel 100 on either side of the axis A. Preferably, each flap 120, 140 is pivotal about folds 102, 104 in a direction generally parallel to the axis A so as to move from a first position disposed away from the axis A (as shown in FIG. 5) to a second position that abuts or overlies the first panel (as shown in FIG. 6). As illustrated (in FIG. 5), flap 120 has a securement 122 usable to secure the first and second panels in the folded position shown in FIG. 6.

Figure 2:
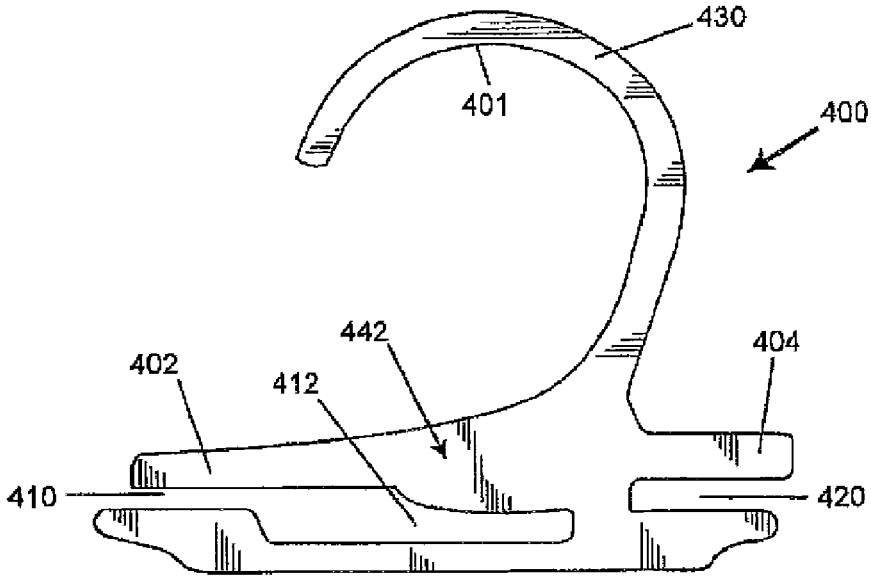
FIG. 2 is a side plan view of the hanger in accordance with the preferred embodiment.

As illustrated in FIG. 2, the hanger 400 comprises a hook 401 and a neck 430 extending downwardly toward an engagement surface which is larger than the hole 200 in at least one dimension. The neck 430 extends the hook 401 above the fold line 202 to facilitate hanging the display unit 10.

As shown in FIG. 2, the engagement surface can comprise first and second shoulders 402, 404. The shoulders each have top and bottom surfaces with a slot 410, 420 therebetween. The slot extends toward each other to a depth, leaving a base 442 that connects the shoulder portions to the neck 430. An internal cavity 412 is in communication with and is sized to permit engagement of the hook in the hole so that the top and bottom portions can be seated on opposing sides of the substrate 90.

Figure 3:
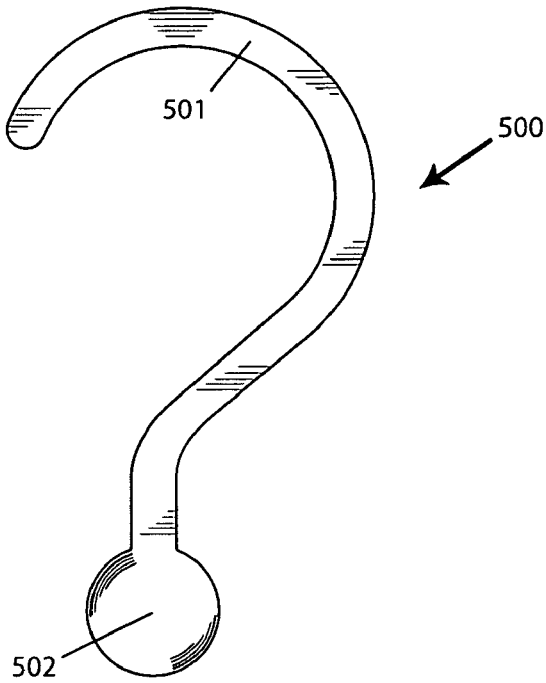
FIG. 3 is a side plan view of a first variation of the hanger of FIG. 2.

A variation of the engagement surface 440 is shown in FIG. 3 and has a hook 501 and a bulbous end 502 at the bottom of the hanger 500 sized to be urged through the hole 200 in the display unit 10 in at least one dimension and stay seated therein while overcoming the weight of the tie, handkerchief and display unit 10. In other words, the hole 200 is somewhat smaller than the center of the bulbous end 502 in at least one dimension.

Figure 4:
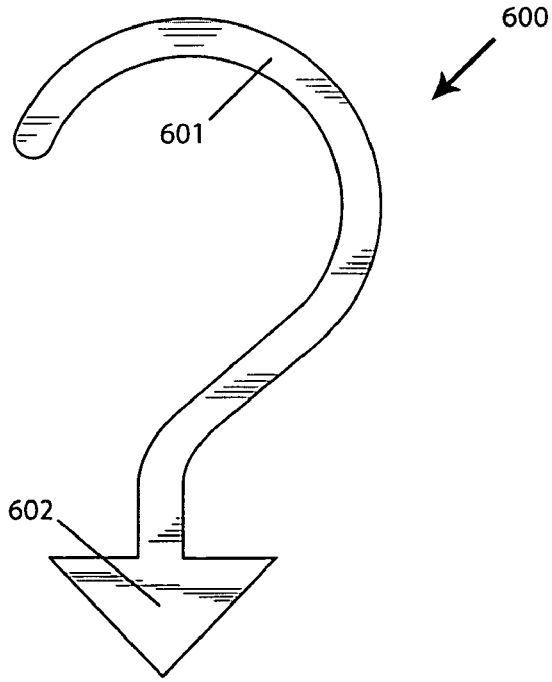
FIG. 4 is a side plan view of a second variation of the hanger of FIG. 2.

Another variation of the engagement surface 440 is shown in FIG. 4 and has a hook 601 and a pointed end 602 at the bottom of the hanger 600 sized to be urged through the hole 200 in the display unit 10 in at least one dimension and stay seated therein while overcoming the weight of the tie, handkerchief and display unit 10. In other words, the hole 200 is somewhat smaller than a portion of the pointed end 602 in at least one dimension.

Figure 7:
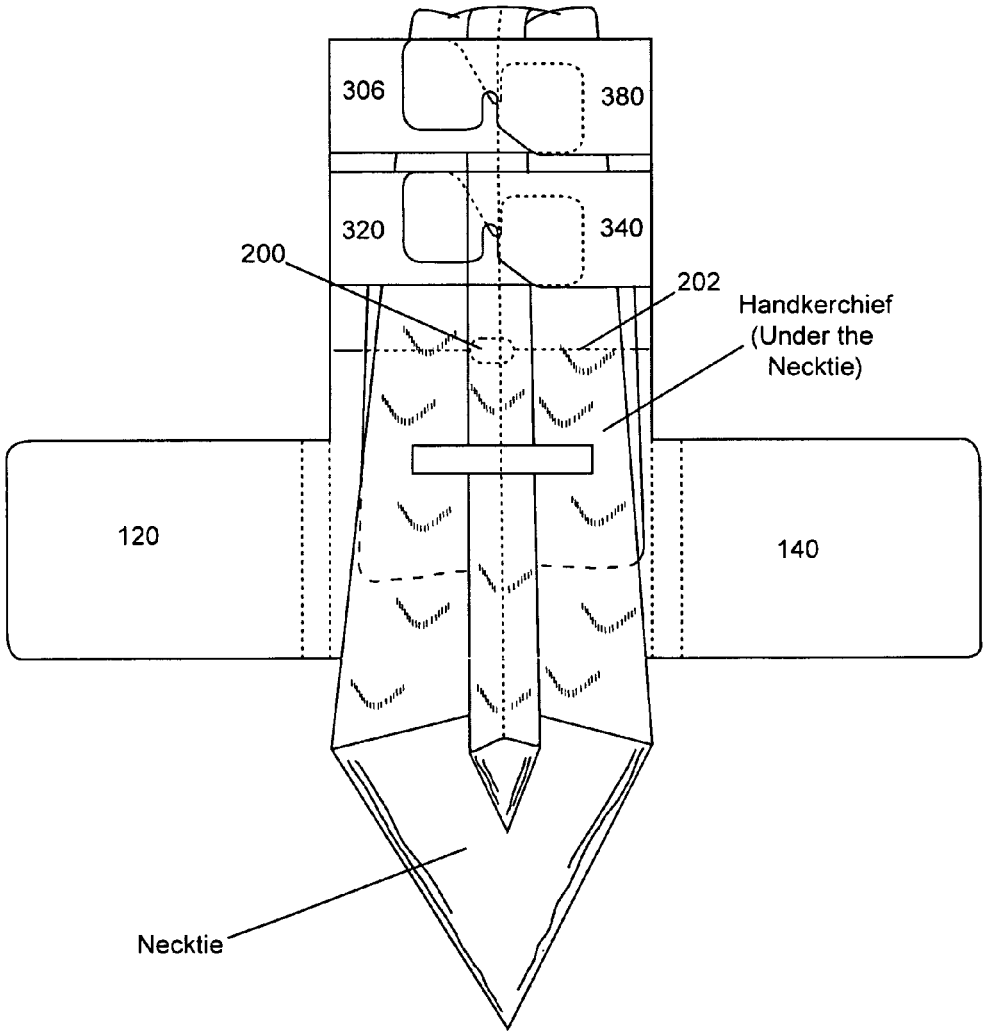
FIG. 7 is an inside top plan view of the embodiment of FIG. 1 illustrating a tie and a handkerchief when disposed thereupon.

A method for combining a necktie and handkerchief into a display unit 10 can comprise the following steps. The handkerchief is first disposed onto the substrate 90 with the panels 320-380 in the first position (as shown in FIG. 1). The flaps 360, 380 are folded on top of the handkerchief into the second position and secured together (see FIG. 7). Preferably, the top portion of the handkerchief is then folded over the flaps 360, 380. A necktie is then disposed on top of the handkerchief and the flaps 360, 380 also onto the substrate 90. The flaps 320, 340 are then folded on top of the necktie into the second position and secured together (as shown in FIG. 7). The second panel 300 is then folded along the fold 202 as to overlie the first panel 100 with the handkerchief and necktie disposed therebetween. The first flaps 120, 140 are then folded over the now connected first panel 100 and second panel 300 and secured using the securement 122 (as shown in FIG. 6).

At one point in the process, the engagement surface of the hanger 400 is brought into contact with the substrate to complete the display unit.

While the invention has been described in connection with certain embodiments thereof, the invention is capable of being practiced in other forms and using other materials and structures. Accordingly, the invention is defined without limitation by the claims appended hereto.

What is claimed is:

1. A display unit for a tie and a handkerchief, comprising:

a substrate having a first panel and a second panel arranged along an axis and being integral and continuous with the first panel, a pair of first flaps, each flap being attached to the first panel of the substrate on an opposing side of the axis being pivotal in a first direction that is generally parallel to the axis;

a pair of second flaps, each flap being attached to opposing side edges of the second panel of the substrate on an opposing side of the axis being pivotal in the first direction;

a pair of third flaps, each flap being attached to the opposing edges of the second panel of the substrate on an opposing side of the axis being pivotal in the first direction, a hole through the substrate;

a fold defined at the union of the first and second panels, wherein the pairs of second and third flaps are located on the same side of the fold when the substrate is flat prior to being folded into an assembled position;

a hanger seated in the hole, the hanger comprising a hook, a neck depending downwardly from the hook, and an engagement surface connected to the neck which surface is larger than the hole; and a securement holding the pair of first and second panels to one another, wherein the pair of first flaps has dimensions greater than dimensions of the pairs of second and third flaps such that when in the assembled position the first flaps are folded on top of one another and on top of both the second and third flaps when the second and third flaps are folded and secured to one another resulting in the first flaps at least partially covering the pairs of second and third flaps.

2. The display unit of claim 1, wherein the neck extends the hook above the fold line to facilitate hanging the display unit.

3. The display unit of claim 1, wherein the engagement surface further comprises first and second shoulders each having a top portion and a bottom portion and a respective slot separating the top and bottom portions, the slot of each shoulder extending toward the other shoulder to a depth.

4. The display unit of claim 3, wherein the slots extend toward one another.

5. The display unit of claim 3, further comprising an internal cavity within the first shoulder, wherein the slot of the first shoulder communicates with the internal cavity.

6. The display unit of claim 5, wherein the internal cavity is disposed below the slot of the first shoulder and disposed inwardly of the depth of the first shoulder slot.

7. The display unit of claim 6, wherein the internal cavity extends toward the second shoulder yet remains out of communication with the slot of the second shoulder.

8. The display unit of claim 3, wherein the slots of the first and second shoulders engage the substrate when the hanger is seated within the hole.

9. The display unit of claim 1, wherein the hole has a first dimension in the first direction and a second dimension in a second direction that is generally transverse to the axis, wherein the engagement surface comprises first and second shoulders extending away from one another so as to have a combined length which is longer than the second dimension.

10. The display unit of claim 1, wherein the hole is aligned with the axis.

11. The display unit of claim 1, wherein at least one flap in the pair of first flaps and at least one flap in the pair of second flaps has a first position disposed away from the axis and is moveable to a second position that overlies the axis.

12. The display unit of claim 1, wherein the first and second panels are movable about the fold so as to abut one another on opposite sides of the fold and secure the tie and the handkerchief.

13. The display unit of claim 1, wherein the securement includes one securement member that is disposed on the one of the first flaps, the securement member being adapted to secure the first and second panels in a folded position.

14. A retail display comprising:

a substrate having a first panel and a second panel arranged along an axis and being integral and continuous with the first panel, a pair of first flaps, each flap being attached to the first panel of the substrate on an opposing side of the axis being pivotal in a first direction that is generally parallel to the axis;

a pair of second flaps, each flap being attached to opposing edges of the second panel of the substrate on an opposing side of the axis being pivotal in the first direction;

a hole through the substrate;

a fold defined at the union of the first and second panels;

a hanger seated in the hole, the hanger comprising a hook, a neck depending downwardly from the hook, and an engagement surface connected to the neck which surface is larger than the hole;

a securement holding the pair of first and second panels to one another;

a handkerchief that is disposed onto the substrate, the pair of second flaps being folded and secured to one another to secure the handkerchief along the second panel;

a tie disposed over the handkerchief and over the folded, secured pair of second flaps; and a pair of third flaps, each flap being attached to the opposing edges of the second panel of the substrate on an opposing side of the axis being pivotal in the first direction, the pair of third flaps being folded over the necktie and secured to one another;

wherein the pairs of second and third flaps are located on the same side of the fold when the substrate is flat prior to being folded into an assembled position;

wherein in an assembled position, the substrate is folded about the fold resulting in the first and second panels to overlie one another with the handkerchief and the disposed between the first and second panels, and wherein the pair of first flaps has dimensions greater than dimensions of the pairs of second and third flaps such that when in the assembled position, the first flaps are folded on top of one another and on top of both the second and third flaps when the second and third flaps are folded and secured to one another resulting in the first flaps at least partially covering and being disposed directly over the pairs of second and third flaps.

15. The retail display of claim 14, wherein the tie is folded prior to being over the handkerchief and the folded pair of second flaps.

16. The retail display of claim 14, wherein in the assembled position, a portion of the handkerchief and the tie is visible below the overlying first and second panels.

* * * * *